US009718291B2

(12) United States Patent
Elferink

(10) Patent No.: US 9,718,291 B2
(45) Date of Patent: Aug. 1, 2017

(54) PRINTER CARRIAGE SUPPORT STRUCTURE

(71) Applicant: OCE-TECHNOLOGIES B.V., Venlo (NL)

(72) Inventor: Maarten J. H. Elferink, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/282,249

(22) Filed: Sep. 30, 2016

(65) Prior Publication Data

US 2017/0106684 A1 Apr. 20, 2017

(30) Foreign Application Priority Data

Oct. 16, 2015 (EP) ..... 15190158

(51) Int. Cl.
*B41J 25/00* (2006.01)
*B41J 2/01* (2006.01)

(52) U.S. Cl.
CPC ..... *B41J 25/001* (2013.01); *B41J 2/01* (2013.01)

(58) Field of Classification Search
CPC . B41J 11/22; B41J 19/00; B41J 25/304; B41J 25/308; B41J 25/3086; B41J 25/3088
See application file for complete search history.

(56) References Cited

U.S. PATENT DOCUMENTS 5,495,279 A * 2/1996 Sandstrom ..... H04N 1/1008 347/258
5,650,820 A * 7/1997 Sekine ..... B41J 11/22 346/139 R (Continued)

FOREIGN PATENT DOCUMENTS

EP 0 980 762 A2 2/2000
WO WO 2010/101034 A1 9/2010

(Continued)

*Primary Examiner* — Matthew Luu
*Assistant Examiner* — Patrick King
(74) *Attorney, Agent, or Firm* — Birch, Stewart, Kolasch & Birch, LLP

(57) ABSTRACT

A printing assembly comprises a medium support surface, a guide assembly and a carriage support structure for moveably supporting a print head carriage on the guide assembly. The guide assembly is arranged to move the print head carriage in a carriage plane, which carriage plane is parallel to the medium support surface. The guide assembly comprises a guide beam; and a guide rail arranged on the guide beam. The guide rail and the guide beam each extend in a scanning direction. The printer carriage support structure comprises a guide frame arranged on the guide rail and the guide frame is moveable in the scanning direction and extends in the scanning direction between a first support position and a second support position. The guide frame is supported on the guide rail at said first support position and at said second support position. A carriage frame is moveably supported on the guide rail through the guide frame. The carriage frame is coupled to the guide frame such that the carriage frame is moveable relative to the guide frame in the carriage plane.

9 Claims, 5 Drawing Sheets

(56) References Cited

U.S. PATENT DOCUMENTS

| | | | | |
|---|---|---|---|---|
| 5,907,413 | A * | 5/1999 | Han | H04N 1/00541 358/474 |
| 6,031,597 | A * | 2/2000 | Knirck | G03F 7/20 355/53 |
| 7,488,957 | B2 * | 2/2009 | Ekberg | G03F 7/70791 250/492.1 |
| 7,705,967 | B2 * | 4/2010 | Opower | G03F 7/70391 355/53 |
| 2006/0027538 | A1 * | 2/2006 | Ekberg | G03F 7/70791 219/121.8 |
| 2009/0152794 | A1 * | 6/2009 | Ishida | B41J 25/308 271/8.1 |
| 2011/0199430 | A1 * | 8/2011 | Yajima | B41J 19/00 347/37 |
| 2012/0320127 | A1 * | 12/2012 | Kikura | B41J 2/1752 347/37 |

FOREIGN PATENT DOCUMENTS

| | | | |
|---|---|---|---|
| WO | WO 2015/082510 | A1 | 6/2015 |
| WO | WO 2015/095990 | A1 | 7/2015 |

* cited by examiner

PRINTER CARRIAGE SUPPORT STRUCTURE

FIELD OF THE INVENTION

The present invention generally pertains to a printing assembly, wherein a carriage supporting at least one print head is moved in a carriage plane over a medium support surface.

BACKGROUND ART

A commonly known printing assembly comprises a carriage supporting a print head.

The print head is configured to expel droplets of a recording substance, such as ink, on a recording medium. The expelled droplets form image dots on the recording medium.

Image-wise positioning of the dots results in an image. For image-wise positioning, the carriage is moveable in a carriage plane, which carriage plane is substantially parallel to a medium support surface, the recording medium being supported on such medium support surface. The print head is controlled to expel a droplet at each position where an image dot is needed to form the image.

In a known printing assembly, the carriage is moved along a gantry in a scanning direction and the gantry is configured to be moveable in a transport direction, the transport direction being substantially perpendicular to the scanning direction. Thus, the print head may be positioned in two direction, enabling to position the image dots in a two-dimensional array.

For a high image quality, it is required that image dots are positioned as accurate as possible. For high productivity, it is required that the carriage moves at a high speed and is able to quickly decelerate and accelerate. Other specific requirements can be imposed on the carriage and its support structure depending on the requirements and applications of the printing assembly. In any case, the functional requirements imposed on the carriage require a suitable design of the carriage and gantry.

SUMMARY OF THE INVENTION

In an aspect of the present invention, a printing assembly is provided, wherein the printing assembly comprises a medium support surface, a guide assembly and a carriage support structure for moveably supporting a print head carriage on the guide assembly. The guide assembly is arranged to move the print head carriage in a carriage plane, which carriage plane is parallel to the medium support surface. The guide assembly comprises a guide beam and a guide rail arranged on the guide beam. The guide rail and the guide beam each extend in a scanning direction. The printer carriage support structure comprises a guide frame arranged on the guide rail, wherein the guide frame is moveable in the scanning direction and extends in the scanning direction between a first support position and a second support position. The guide frame is supported on the guide rail at said first support position and at said second support position. The printer carriage support structure further comprises a carriage frame moveably supported on the guide rail through the guide frame. The carriage frame is coupled to the guide frame such that the carriage frame is moveable relative to the guide frame in the carriage plane and the carriage frame is positioned in the carriage plane relative to the guide beam by support means. The support means support the carriage frame against a flat surface provided by the guide beam.

In the above printing assembly, the movement of the print head carriage along the guide beam is supported by the guide rail. Still, the guide rail may be expected to not be infinitely straight. For control of positioning, such straightness of movement of the print head carriage may be desired. Hence, any deviation of the guide rail from straightness potentially negatively affects the positioning of image dots. In order to isolate the shape of the guide rail from the direction of movement of the print head carriage and in accordance with the present invention, the print head carriage is supported through a guide frame on the guide rail and the coupling between the guide frame and the print head carriage enables restricted free movement of the print head carriage relative to the guide frame in the carriage plane. This construction enables to determine the position in the carriage plane based on a reference to another object than the guide rail, thereby isolating any deviations in the guide rail from the print head carriage position.

In particular, the position in the carriage plane is determined relative to the guide beam.

Thereto, support means supporting the carriage frame against a flat surface provided by the guide beam are provided. The position of the carriage frame is thus determined by the position and shape of the flat surface of the guide beam. Such a flat surface (used as a reference surface) may be configured and arranged to provide for a highly accurate positioning, independent of any deviations of the guide rail in the scanning direction. A suitable support means may be an air bearing, a rolling means such as a wheel, a gliding means and any other moveably supporting means, which may be easily selected by any person skilled in the relevant art.

It is noted that generally, the carriage frame may be suitably positioned in the carriage plane relative to the guide beam irrespective of the particular support construction. For example, the guide rail may be mounted on a rail surface of the guide beam and a flat surface of the guide beam, supporting the print head carriage in the carriage plane, is perpendicular to the rail surface.

In an embodiment, the guide frame and the carriage frame are coupled by a coupling structure and the coupling structure is configured to constrain the carriage frame relative to the guide frame in at most four degrees of freedom. In other words, at least two degrees of freedom are not constrained by the coupling structure. Preferably, a translation in a transport direction, i.e. a direction substantially perpendicular to the scanning direction, and a rotation in the carriage plane are not constrained by the coupling structure.

The at most four degrees of freedom constrained by the coupling structure include: (1) a translation in the scanning direction, which corresponds to the desired print head carriage scanning movement for forming a swath of image dots and is governed by the movement along the guide rail; (2) a translation in the direction perpendicular to the carriage plane, which corresponds to supporting the print head carriage and keeping the print head carriage in the carriage plane; (3) a rotation around the scanning direction and (4) a rotation around the transport direction, which both also relate to the support of the print head carriage.

In a particular embodiment, the coupling structure comprises at least one pen-like coupling element, such as an antenna, for constraining a respective one degree of freedom, each pen-like coupling element constraining in a direction of its length and allowing movement in any other direction.

In an embodiment, the print head carriage is hanging on the guide frame. In a particular embodiment, the guide frame and the carriage frame are coupled by a coupling structure, wherein the coupling structure constrains a downward movement of the carriage frame, while allowing an upward movement. In such embodiment, the carriage frame is positioned relative to the medium support surface (keeping the print head carriage in the carriage plane), while allowing the carriage frame to be lifted away from the medium support surface. Such lifting of the print head carriage prevents damage to the print heads, if an obstacle is present on the medium support surface.

In an embodiment, the carriage frame is hanging and cantilevered, while the carriage frame is rotationally held in position by the support means supporting against the flat surface of the guide beam.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
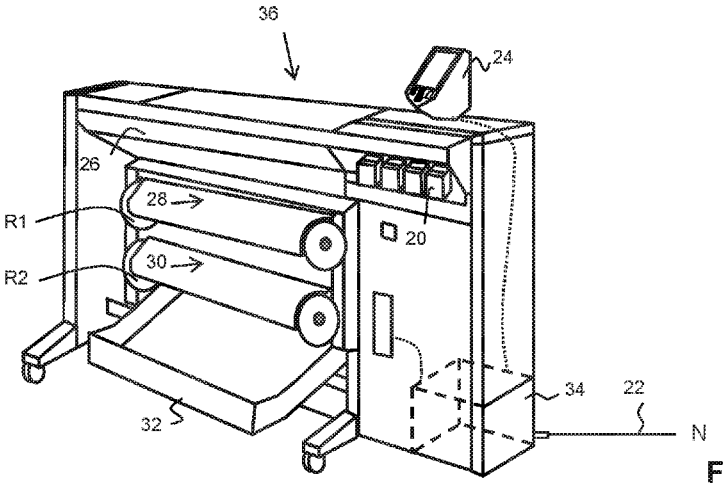
FIG. 1A is a perspective view on an exemplary large format inkjet printing assembly.

The present invention will now be described with reference to the accompanying drawings, wherein the same reference numerals have been used to identify the same or similar elements throughout the several views.

Figure 1B:
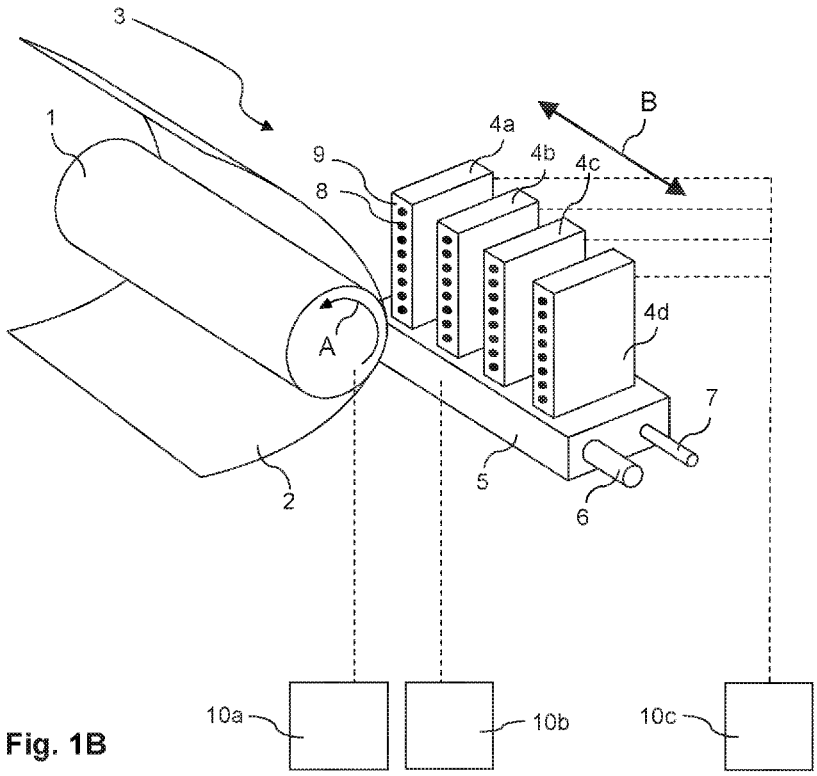
FIG. 1B is a schematic representation of a scanning inkjet system.

FIG. 1A shows an inkjet printing assembly 36, wherein printing is achieved using a wide format inkjet printer. The wide-format inkjet printing assembly 36 comprises a housing 26, wherein the printing assembly, for example the ink jet printing assembly shown in FIG. 1B is arranged. The inkjet printing assembly 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format inkjet printing assembly 36 furthermore comprises means for receiving print jobs and optionally means for manipulating print jobs. These means may include a user interface unit 24 and/or a control unit 34, for example a computer.

Images are printed on an image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The inkjet printing assembly 36 may optionally be connected to a network N. The connection to the network N is diagrammatically shown in the form of a cable 22, but nevertheless, the connection could be wireless. The inkjet printing assembly 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a medium support surface 1, but alternatively, the supporting means may be a flat surface. The medium support surface 1, as depicted in FIG. B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print head carriage 5. The scanning print head carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The medium support surface 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile.

Alternatively, the image receiving member 2 may also be an intermediate member, endless or not. Examples of endless members, which may be moved cyclically, are a belt or a drum. The image receiving member 2 is moved in the sub-scanning direction A by the medium support surface 1 along four print heads 4*a*-4*d* provided with a fluid marking material.

The scanning print head carriage 5 carries the four print heads 4*a*-4*d* and may be moved in reciprocation in the main scanning direction B parallel to the medium support surface 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print head carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print head carriage 5 compared to print heads 4*a*-4*d* containing marking material in any of the other colors.

Alternatively, the print head 4*a*-4*d* containing black marking material may be larger than any of the print heads 4*a*-4*d*, containing a differently colored marking material.

The print head carriage 5 is guided by guiding means 6, 7. These guiding means 6, 7 may be rods as depicted in FIG. 1B. The rods may be driven by suitable driving means (not shown). Alternatively, the print head carriage 5 may be guided by other guiding means, such as an arm being able to move the print head carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9 may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 1C:
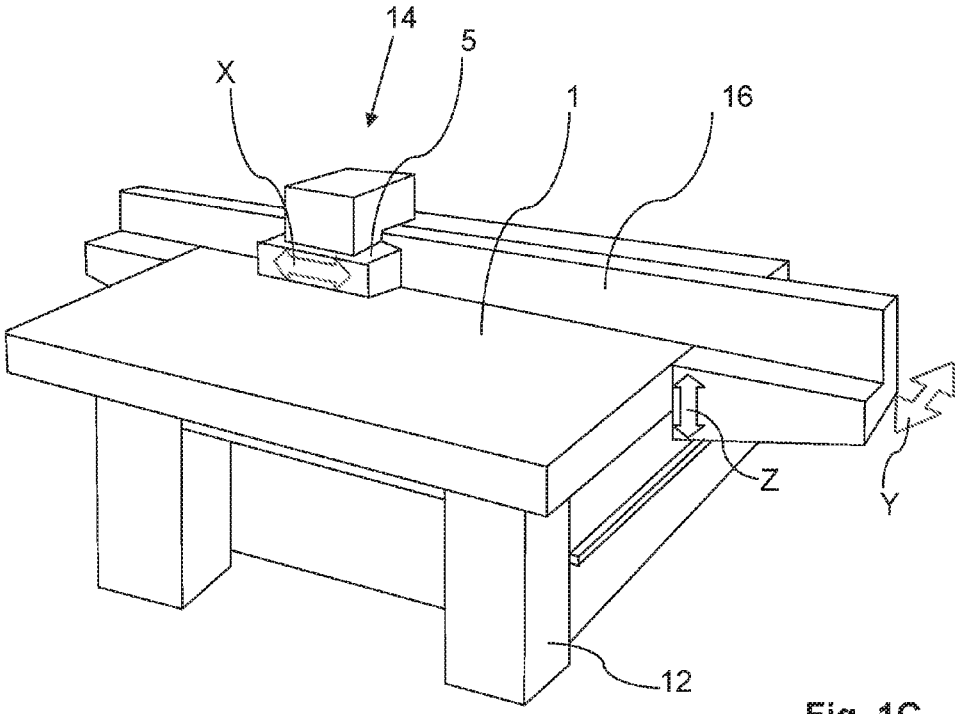
FIG. 1C is a perspective view of another exemplary large format inkjet printing assembly.

FIG. 1C shows another embodiment of an inkjet printing assembly 14 (herein also referred to as a printing apparatus), in which the medium support surface 1 is a flat surface. On the flat surface a flexible medium or a non-flexible flat medium may be arranged and may be printed on. The medium support surface 1 is supported on a suitable support structure 12 and a guide beam 16 is arranged over the medium support surface 1. Such guide beam 16 is also known in the art as a gantry. The guide beam 16 supports the print head carriage 5 such that the print head carriage 5 is enabled to scan in an X-direction. The guide beam 16 is arranged and configured to be enabled to reciprocate in a Y-direction, wherein the Y-direction is usually substantially perpendicular to the X-direction. In a known printing apparatus 14, the guide beam 16 is also arranged and configured to be enabled to move in a Z-direction, which is substantially perpendicular to the X-direction and the Y-direction such to enable to adapt the printing apparatus 14 to a thickness of the recording medium being arranged on the medium support surface 1 and/or to be enabled to print multiple layers on top of each other such to generate height differences in a printed image.

Figure 2A:
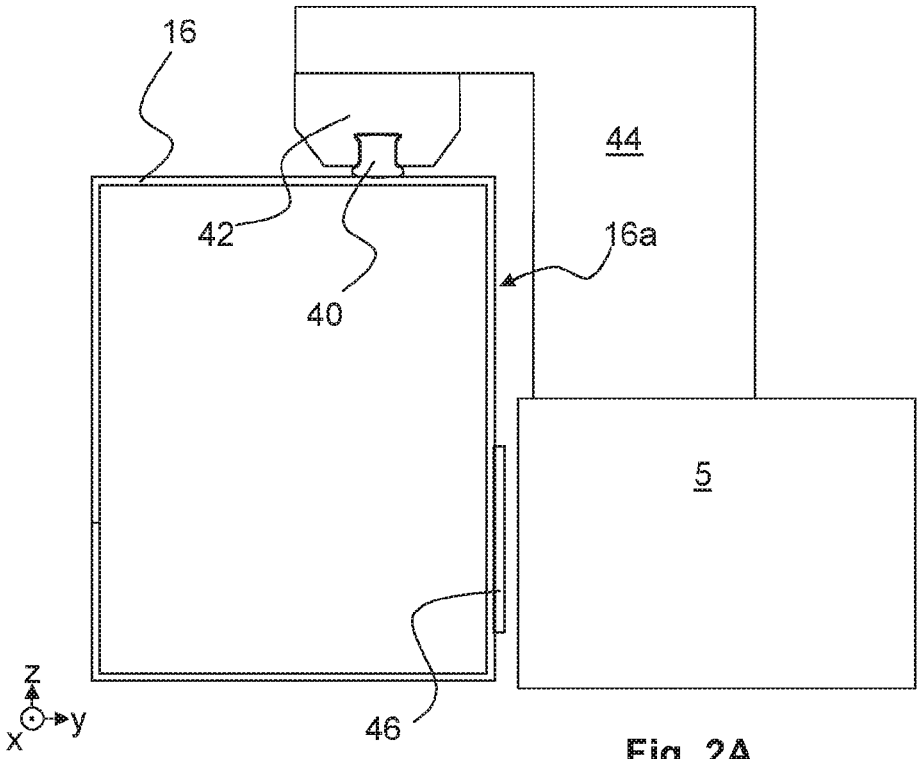
FIG. 2A is a schematical cross-section of a first embodiment of a guide assembly and a printer carriage support structure according to the present invention.

FIG. 2A shows the guide beam 16 in cross-section. In this illustrated embodiment, the guide beam is a thin-walled hollow structure. On the guide beam 16, a guide rail 40 is provided. The guide rail 40 is preferably mounted on the guide beam 16 such that the guide rail 40 extends as much as possible in parallel with a side wall 16*a* of the guide beam 16. A runner block 42 is moveably arranged on the guide rail 40. The runner block 42 is mounted on the guide rail 40 such that the runner block 42 is enabled to move in the direction of and along the guide rail 40 with low friction, while limiting any movement in any other direction (two translations and three rotations as is discussed in more detail below). Moreover, the runner block 42 is configured to support and carry a weight such as the print head carriage 5. A guide frame 44 is arranged on the runner block 42 and couples a carriage frame of the print head carriage 5 to the runner block 42. The print head carriage 5 is thus supported on the guide beam 16.

As apparent to those skilled in the art, the print head carriage 16 is cantilevered and a moment exerts a force on the print head carriage 5 towards the guide beam 16. Suitable means (not shown) such as air bearings, gliders, sliders, wheels, or the like, are used to position the print head carriage 5 relative to the guide beam 16, in particular relative to the side wall 16*a* of the guide beam 16. In an embodiment, a specific guide surface element 46 may be mounted on the side wall 16*a* to provide for a straight trajectory in the scanning direction X. Such a specific guide surface element 46 may be made of glass, since glass is manufactured to be intrinsically straight, smooth and flat and is relatively cheap, which makes glass a cost-effective means for providing a suitable surface for use with air bearings, for example.

Considering that the guide rail 40 may not be ideally straight and hence its position may deviate in the transport direction Y from an ideal position, and considering that the print head carriage 5 preferably moves as little as possible in the transport direction Y during a scanning movement in the X-direction, it is preferred that the print head carriage 5 is enabled to move in a carriage plane relative to the guide rail 40. The carriage plane is substantially parallel to the medium support surface 1, extending in both X-direction and Y-direction. Moving the print head carriage 5 in the carriage plane enables the print heads supported by the carriage frame to provide image dots on every location of the medium support surface 1. As the print head carriage 5 is moved in the carriage plane in the scanning direction X along the side wall 16*a*, the position in the Y-direction is defined by the side wall 16*a*. Deviations in the Y-direction due to position deviations of the guide rail 40 are absorbed by a relative movement of the print head carriage 5. In other words, if the runner block 42 and the guide frame 44 move in the transport direction Y, the carriage frame is coupled such that the carriage frame does not move in the Y-direction; the carriage frame maintains its position relative to the side wall 16*a* or relative to the specific guide surface element 46 mounted on the side wall 16*a*.

Note that it is preferred that the above described support assembly is also designed such that a movement of the runner block 42 in the Y-direction does not result in a torsion of the carriage frame of the print head carriage 5. An over-constrained support assembly would inevitably result in bending of certain elements. Using preferred light-weight construction elements for the carriage frame, it may be presumed likely that the carriage frame may bend resulting in an undesirable and unpredictable change in position of the print head(s) supported by such carriage frame. Such unpredictable changes result in unpredictable image dot positioning and consequently in a deterioration of the resulting image quality. An exemplary, suitably constrained embodiment is illustrated in and described in relation to FIG. 3 in more detail.

Figure 2B:
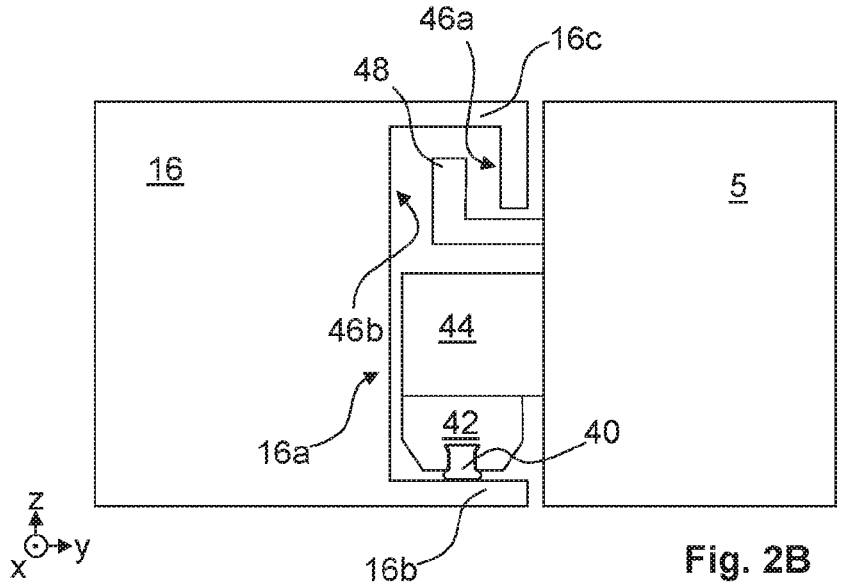
FIG. 2B is a schematical cross-section of a second embodiment of a guide assembly and a printer carriage support structure according to the present invention.

FIG. 2B illustrates a second embodiment, wherein the guide rail 40 is not arranged on top of the guide beam 16 (like in the first embodiment of FIG. 2A), but is arranged on a support protrusion 16*b* extending from the side wall 16*a*. Further, a guide protrusion 16*c* extends from the side wall 16*a*. The runner block 42 and the guide frame 44 are arranged on the guide rail 40. The print head carriage 5 is coupled to the guide frame 44 with the same constraints and preferences as described in relation to the first embodiment of FIG. 2A. To control the cantilevered support of the carriage frame, the carriage frame is provided with a guide extension 48, which is positioned in a recessed groove provided by the guide protrusion 16*c*. The guide extension 48 is provided with suitable means such as air bearings, gliders, sliders, wheels, or the like, supported against a first inner wall surface 46*a*. In such embodiment, the first inner wall surface 46*a* determines a position of the print head carriage 5 in the carriage plane. In a particular embodiment, a further support and guide may be provided by a second inner wall surface 46*b*.

Figure 3:
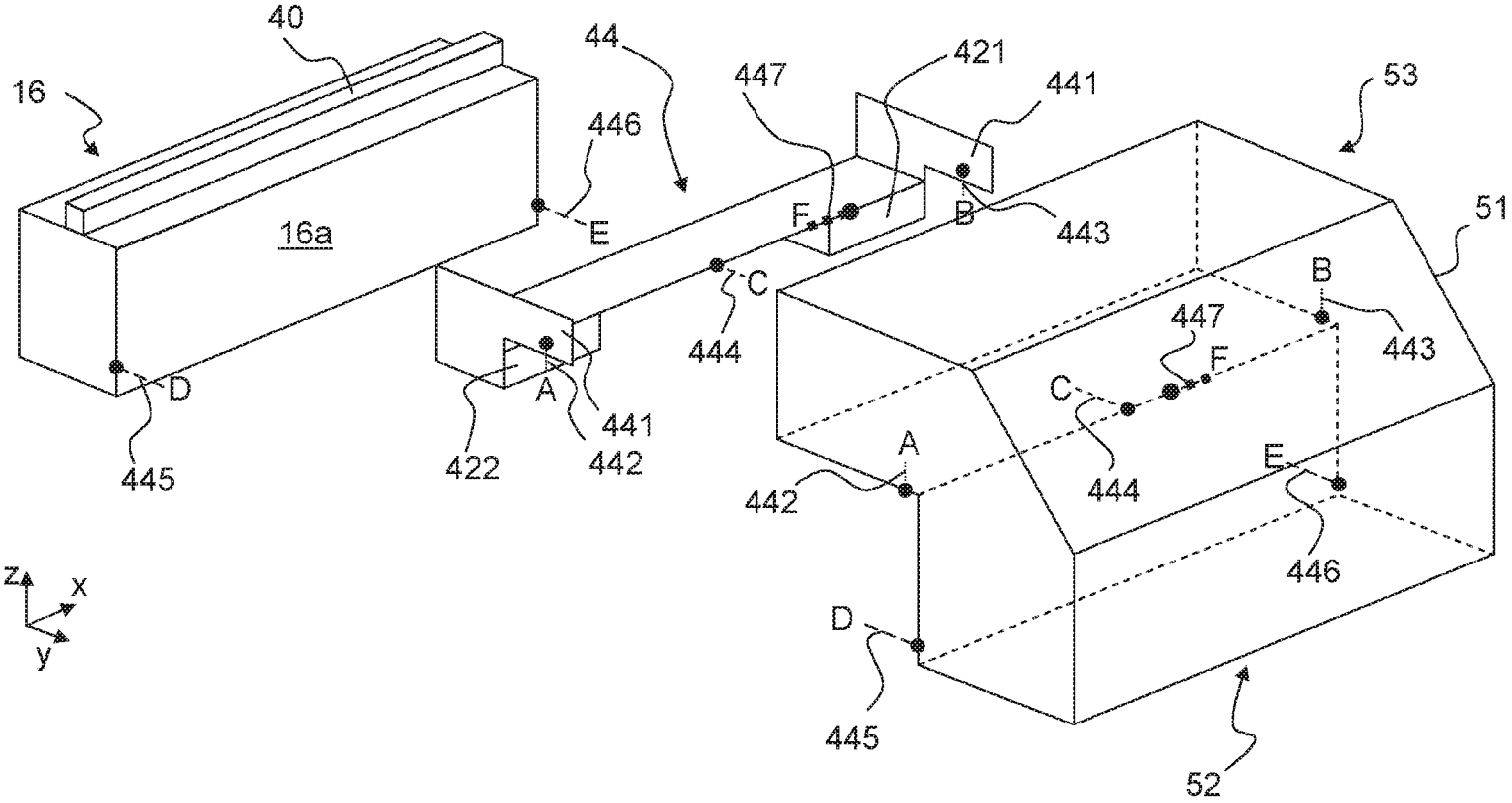
FIG. 3 is a schematical exploded perspective view of a third embodiment of a guide assembly and a printer carriage support structure according to the present invention.
Figure 4A:
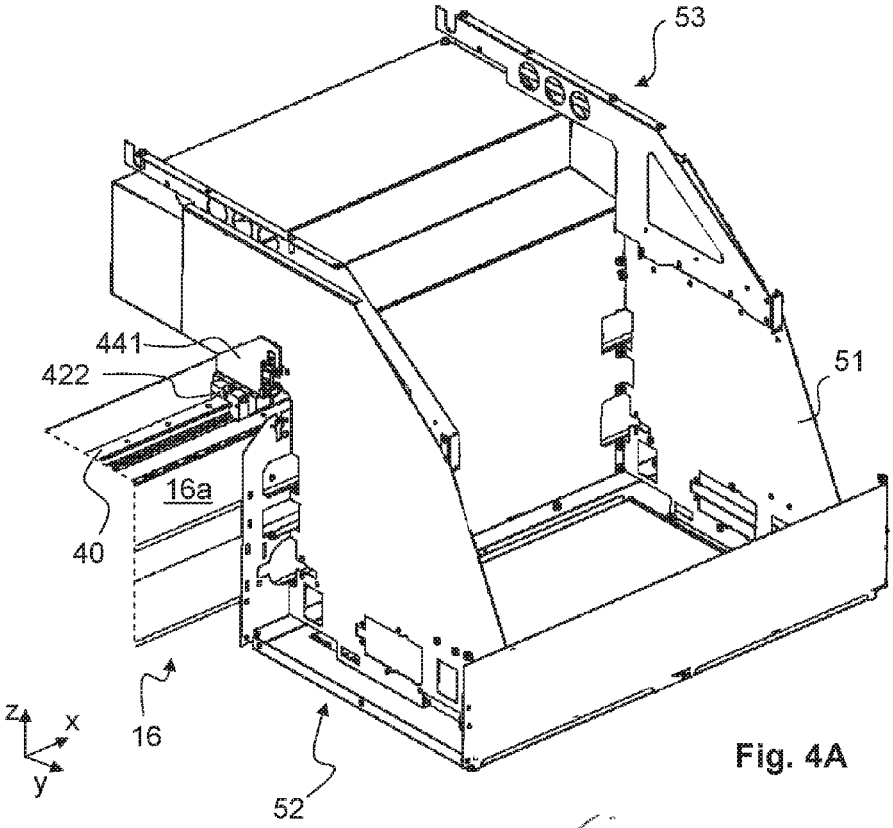
FIG. 4A is a perspective view of the embodiment of FIG. 3.
Figure 4B:
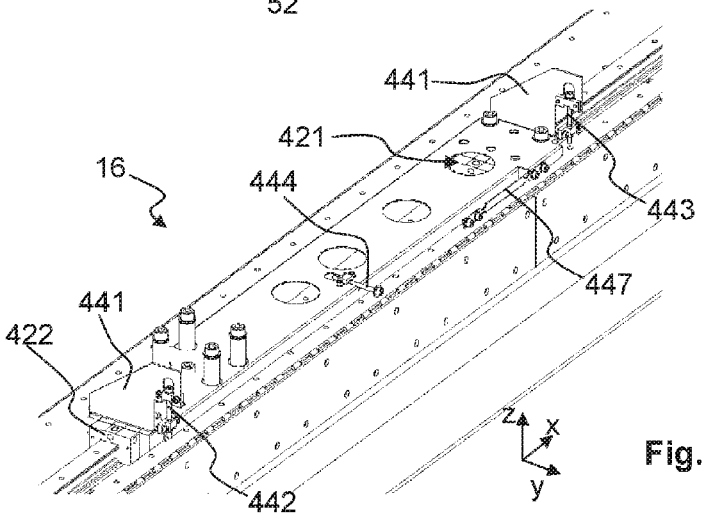
FIG. 4B is a perspective view of the guide beam and the guide frame of the embodiment of FIG. 3.

A specific third embodiment of the present invention is schematically shown in FIG. 3 and illustrated in more detail in FIGS. 4A and 4B. FIG. 3 shows the guide beam 16 having the guide rail 40 arranged thereon. Further, the side wall 16*a* is shown. As mentioned above, a specific guide surface element 46 may be provided on the side wall 16*a* in accordance with any specific requirements of the design.

The guide frame 44 is provided with two runner blocks: a first runner block 421 and a second runner block 422. The first runner block 421 and the second runner block 422 provide a first support position and a second support position, respectively, between which support positions the guide frame 44 extends.

A carriage frame 51 has a lower part 52 and an upper part 53. The lower part 52 is configured to support a number of print heads and is arranged in the carriage plane close to the medium support surface 1. The upper part 53 may be configured to support driver electronic circuitry, a liquid handling assembly, and the like, which are not required to be close to the medium support surface 1. The weight of these elements is thus positioned directly above the guide rail 40 and the support positions provided by the runner blocks 421, 422 and their weight does not add to the moment acting on the carriage frame 51. It is noted that such a moment is still needed to pre-load the carriage frame 51 against the guide beam 16, as described below in more detail, but such moment is generated by the weight of the print heads provided in the lower part 52.

When assembled, the first and the second runner block 421, 422 are positioned on the guide rail 40, supporting the guide frame 44. The guide frame 44 is thus free to move along the guide rail 40. Hence, the guide frame 44 is moveable in the scanning direction X. Translations in the Y-direction and in the Z-direction are constrained. Rotations around the X, Y, Z-directions (X, Y, Z-axes) are constrained too. When arranged on the guide beam 16, supports arms 441 extends over the side wall 16*a*.

The carriage frame 51 is coupled to the guide frame 44 through a suitable coupling structure, which in this embodiment comprises a number of pen-like coupling elements.

Such pen-like coupling elements constrain only in the direction of their length. In other words, each coupling constrains only one degree of freedom, leaving five other degrees of freedom available. Suitable use of such pen-like coupling elements enables to design a support construction without over-constraining. Having a rigid carriage frame 51 without over-constrained support prevents torsion and other distortion of the frame construction, which would be undesirable as above described.

In the exploded view of FIG. 3, the couplings are separated; in the assembled state (shown in FIG. 4A), A is connected to A, B is connected to B, etc.

A first coupling element 442 (A-A) and a second coupling element 443 (B-B) couples a respective one of the support arms 441 of the guide frame 44 and the carriage frame 51. Each of the coupling elements 442, 443 constrains a translation of the carriage frame 51 in the Z-direction. Together, the coupling elements 442, 443 constrain the rotation around the X-axis (rotation around the x-axis may also be referred to as the roll).

A third coupling element 444 (C-C) couples the carriage frame 51 to the guide frame 44 and extends in the transport direction X. Hence, the third coupling element 444 constrains the carriage frame 51 in its rotation around the Y-axis (also referred to as pitch or tilt).

A fourth coupling 445 (D-D) and a fifth coupling 446 (E-E) are above described and are not formed by pen-like coupling elements, but may be air bearings, gliders, sliders, wheels, or other elements providing support against the side wall 16*a* in the transport direction Y, while allowing low-friction movement along the side wall 16*a* in the scanning direction X. So, each of the fourth coupling 445 and the fifth coupling 446 constrain the carriage frame 51 in the Y-direction and together constrain the carriage frame 51 in the rotation around the Z-axis (also referred to as yaw). Note that the third, fourth and fifth couplings 444, 445, 446 together affect the roll.

A sixth coupling element 447 is provided between the carriage frame 51 and the guide frame 44. The sixth coupling element 447 extends in the scanning direction Y. In the present embodiment and as shown in detail in FIG. 4B, the sixth coupling element 447 is not a pen-like element, but a sheet metal element functioning as an antenna (i.e. a pen-like element). Thereto, the sheet metal element 447 is provided with two elastic joints (reduced width). The sixth coupling element 447 constrains the relative translation in the scanning direction Y between the guide frame 44 and the carriage frame 51.

In an embodiment, the first coupling element 442 and the second coupling element 443 are configured to constrain a movement of the carriage frame 51 towards the medium support surface 1, while allowing a movement of the carriage frame 51 away from the medium support surface 1. In such embodiment, any obstacle on the medium support surface 1 may tilt the carriage frame 51 without permanently affecting (i.e. distorting or damaging) the carriage construction and/or the print heads.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing assembly comprising a medium support surface, a guide assembly and a printer carriage support structure for moveably supporting a print head carriage on the guide assembly via a carriage frame, wherein the guide assembly is arranged to move the print head carriage in a carriage plane, which carriage plane is parallel to the medium support surface, the guide assembly comprising a) a guide beam; and b) a guide rail arranged on the guide beam, wherein the guide rail and the guide beam each extend in a scanning direction;

the printer carriage support structure comprising c) a guide frame arranged on the guide rail, the guide frame being moveable in the scanning direction and extending in the scanning direction between a first support position and a second support position, wherein the guide frame is supported on the guide rail at said first support position and at said second support position; and d) the carriage frame moveably supported on the guide rail through the guide frame;

wherein the carriage frame is coupled to the guide frame such that the carriage frame is moveable relative to the guide frame in the carriage plane and wherein the carriage frame is positioned in the carriage plane relative to the guide beam by support means, the support means supporting the carriage frame against a flat surface provided by the guide beam.

2. The printing assembly according to claim 1, wherein the guide frame and the carriage frame are coupled by a coupling structure and wherein the coupling structure is configured to constrain the carriage frame relative to the guide frame in at most four degrees of freedom.

3. The printing assembly according to claim 2, wherein the coupling structure comprises at least one pen-like coupling element for constraining a respective one degree of freedom, each pen-like coupling element constraining in a direction of its length and allowing movement in any other direction.

4. The printing assembly according to claim 1, wherein the carriage frame is hanging on the guide frame.

5. The printing assembly according to claim 4, wherein the guide frame and the carriage frame are coupled by a coupling structure and wherein the coupling structure constrains a downward movement of the carriage frame, while allowing an upward movement such to position the carriage frame relative to the medium support surface, while allowing the carriage frame to be lifted away from the medium support surface.

6. The printing assembly according to claim 4, wherein the carriage frame is cantilevered and wherein the carriage frame is rotationally held in position by a support means supporting against a surface of the guide beam.

7. The printing assembly according to claim 6, wherein the support means comprises an air bearing supporting against a smooth, flat surface provided by the guide beam.

8. The printing assembly according to claim 1, wherein the support means comprises an air bearing supporting against the flat surface of the guide beam.

9. The printing assembly according to claim 1, wherein the guide rail is mounted on a rail surface of the guide beam and the flat surface is perpendicular to the rail surface.

* * * * *